US011214432B2

(12) United States Patent
Rideg

(10) Patent No.: US 11,214,432 B2
(45) Date of Patent: Jan. 4, 2022

(54) SOLID MATTER VALVE FOR PRESSURIZED CANS

(71) Applicant: Gàbor Fazekas, Budapest (HU)

(72) Inventor: Mihály Rideg, Budapest (HU)

(73) Assignee: Gábor Fazekas, Budapest (HU)

( * ) Notice: Subject to any disclaimer, the term of this patent is extended or adjusted under 35 U.S.C. 154(b) by 0 days.

(21) Appl. No.: 16/636,593

(22) PCT Filed: Aug. 16, 2018

(86) PCT No.: PCT/EP2018/072224
§ 371 (c)(1),
(2) Date: Feb. 4, 2020

(87) PCT Pub. No.: WO2019/034733
PCT Pub. Date: Feb. 21, 2019

(65) Prior Publication Data

US 2020/0369457 A1 Nov. 26, 2020

(30) Foreign Application Priority Data

Aug. 16, 2017 (DE) ..... 10 2017 118 704.9

(51) Int. Cl.
*B65D 83/48* (2006.01)
*B65D 83/38* (2006.01)

(52) U.S. Cl.
CPC ..... *B65D 83/48* (2013.01); *B65D 83/38* (2013.01)

(58) Field of Classification Search
CPC ..... B65D 83/44–54
(Continued)

(56) References Cited

U.S. PATENT DOCUMENTS 2,949,243 A * 8/1960 Wilhelm ..... B65D 83/48 239/579
2,989,217 A * 6/1961 Focht ..... B65D 83/20 222/402.2

(Continued)

OTHER PUBLICATIONS

Contents _ Definition of Contents by Merriam-Webster; obtained on Mar. 8, 2021 from Merriam-Webster online dictionary; https://www.merriam-webster.com/dictionary/contents.*

(Continued)

*Primary Examiner* — Paul R Durand
*Assistant Examiner* — Randall A Gruby
(74) *Attorney, Agent, or Firm* — Brooks Kushman P.C.

(57) ABSTRACT

The invention relates to a solid matter valve for pressurized cans, in particular for the dispensing/discharging of assembly foams, with a valve disk (1), a valve body (2) arranged in the valve disk (1), a stem (3) mounted in a central cuts out (21) of the valve body (2) and having at least one inlet opening (33) for the contents of the pressurized can, said opening being cleared by actuation of the stem (3), with at least one discharge opening, a duct (34) connecting the inlet opening (33) with the discharge opening, at least one sealing element (23) acting between the valve body (2) and the stem (3), as well as a spring element (40), wherein the stem (3) is designed so as to form two parts, the upper part (3*a*) being connected to the lower part (3*b*) in a form-closed or force-closed manner, a circumferential elastic diaphragm (22) integrally connecting the valve body (2) to the upper part (3*a*) of the stem (3), and the two parts (3*a*, 3*b*) of the stem (3) forming a functional unit which accommodates the duct (34).

12 Claims, 2 Drawing Sheets

Figure 1:
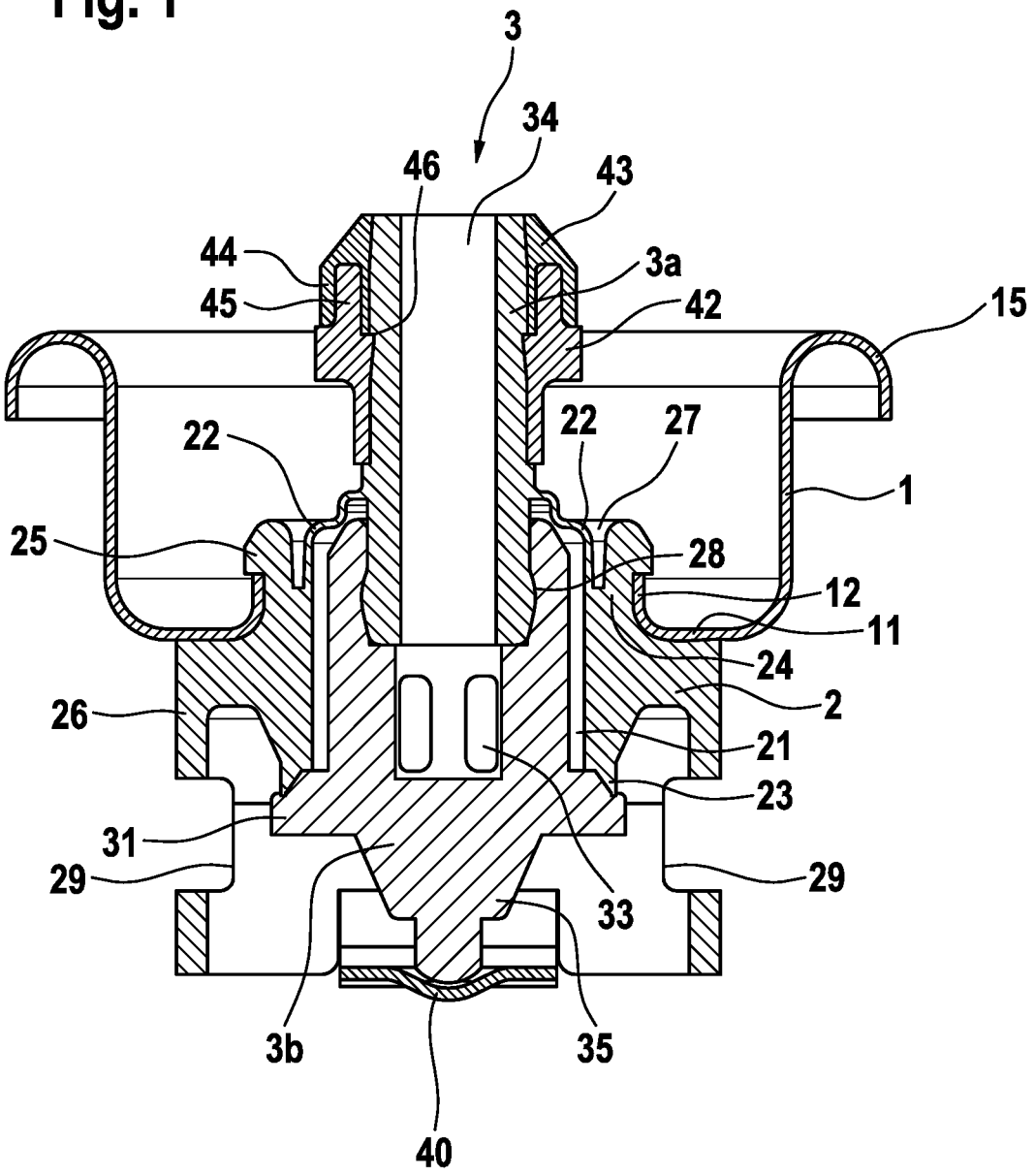

(58) Field of Classification Search
USPC ..... 222/402.1–402.25
See application file for complete search history.

(56) References Cited

U.S. PATENT DOCUMENTS 3,076,609 A * 2/1963 Stocker ..... B65D 83/14 239/579
3,079,048 A * 2/1963 Wolfson ..... B65D 83/46 222/108
3,146,922 A * 9/1964 Tuttle, Jr. ..... B65D 83/207 222/402.12
3,159,318 A * 12/1964 Green ..... B65D 83/48 222/402.18
3,195,787 A * 7/1965 Kitabayashi ..... B65D 83/207 222/402.24
3,201,081 A * 8/1965 Lyon ..... B65D 83/48 251/172
3,209,960 A * 10/1965 Green ..... B65D 83/44 222/402.24
3,231,150 A * 1/1966 Wilhelm ..... B65D 83/546 222/355
3,254,676 A * 6/1966 Beard, Jr. ..... B65D 83/46 137/630.22
3,269,615 A * 8/1966 Ferry, Jr. ..... B65D 83/546 222/402.2
3,375,957 A * 4/1968 Kuffer ..... B65D 83/46 222/402.16
3,434,633 A * 3/1969 Green ..... B65D 83/46 222/402.13
3,434,695 A * 3/1969 Green ..... B65D 83/46 251/349
3,620,421 A * 11/1971 MacGuire-Cooper ..... B65D 83/48 222/402.21
3,777,946 A * 12/1973 Livingstone ..... B65D 83/207 222/402.2
3,977,575 A * 8/1976 Macquire-Cooper ..... B65D 83/38 222/396
3,990,613 A * 11/1976 Wray ..... B65D 83/48 222/402.24
4,522,318 A * 6/1985 Del Bon ..... B65D 83/48 222/402.24
4,671,436 A * 6/1987 Hagan ..... B67D 1/0456 215/4
4,852,807 A * 8/1989 Stoody ..... B65D 83/46 239/337
4,887,743 A * 12/1989 Blake ..... B65D 83/48 222/402.1
4,915,262 A * 4/1990 Suck ..... B65D 83/546 222/207
4,978,035 A * 12/1990 Morane ..... B05B 11/3097 222/108
4,991,751 A * 2/1991 Naku ..... B65D 83/546 222/402.13
5,014,887 A * 5/1991 Kopp ..... B65D 83/48 222/402.1
5,027,985 A * 7/1991 Abplanalp ..... B65D 83/48 222/402.1
5,762,319 A * 6/1998 Kopp ..... B65D 83/48 251/149.6
5,927,563 A * 7/1999 Kellner ..... B65D 83/48 222/402.22
6,058,960 A * 5/2000 Kopp ..... B65D 83/48 137/68.11
6,170,537 B1 * 1/2001 Lasserre ..... B65D 83/425 141/20
8,371,481 B2 * 2/2013 Kopp ..... B65D 83/48 222/402.1
10,632,486 B2 * 4/2020 Schroer ..... B65D 83/207
2007/0007309 A1 * 1/2007 Eberhardt ..... B65D 83/46 222/402.13
2009/0261130 A1 * 10/2009 Pittl ..... B65D 83/38 222/402.1

OTHER PUBLICATIONS

Discharge_ Definition of Discharge by Merriam-Webster; obtained on Mar. 8, 2021 from Merriam-Webster online dictionary; https://www.merriam-webster.com/dictionary/discharge.*

Pour_Definition of Pour by Merriam-Webster; obtained on Mar. 8, 2021 from Merriam-Webster online dictionary; https://www.merriam-webster.com/dictionary/pour.*

Lip _ Definition of Lip by Merriam-Webster; obtained on Mar. 8, 2021 from Merriam-Webster online dictionary; https://www.merriam-webster.com/dictionary/lip.*

Stepped, adj. _ Oxford English Dictionary; obtained on Mar. 19, 2021 from Oxford English Dictionary online; https://www.oed.com/view/Entry/189866?result=2&rskey=qQJAEf&.*

Circumferential _ Definition of Circumferential by Merriam-Webster; obtained on Mar. 21, 2021 from Merriam-Webster online dictionary; https://www.merriam-webster.com/dictionary/circumferential#synonyms.*

Sleeve _ Definition of Sleeve by Merriam-Webster; obtained on Mar. 21, 2021 from Merriam-Webster online dictionary; https://www.merriam-webster.com/dictionary/sleeve.*

Pipe _ Definition of Pipe by Merriam-Webster; obtained on Mar. 21, 2021 from Merriam-Webster online dictionary; https://www.merriam-webster.com/dictionary/pipe.*

* cited by examiner

SOLID MATTER VALVE FOR PRESSURIZED CANS

The invention relates to a solid matter valve for pressurized cans, especially for the discharge of assembly foams, said valve being provided with a valve disk, a valve body arranged in a valve disk, a stem supported within a central cutout of the valve body, with at least one inlet opening cleared for the passage of the can contents by actuating said stem as well as at least one discharge opening, one duct connecting the inlet opening to the discharge opening, with at least one sealing element acting between the valve body and the stem, as well as a spring element.

Solid matter valves may in particular be used for discharging assembly and sealing foams from aerosol cans; they are, however, also suitable basically for all types of aerosol cans intended for the discharge of materials/matter having a solids content, for example cans used for discharging paint material, glues, sealing and cleaning agents.

Foams for assembly and mounting purposes, in particular polyurethane foams, are widely used for all kinds of industrial applications. In the building and construction industry they serve to secure elements such as window and door frames as well as other prefabricated components, for the closure of openings and to fill hollow spaces and pockets with foam. More often than not they are used for thermal and sound insulation purposes. Moreover, they are suited to fill hollow spaces and thus prevent the formation of condensate that may cause corrosion problems.

For producing foams prepolymers contained in the can are usually employed that are curing often under the influence of moisture, in particular air humidity. As soon as the mixture of propellant and foaming agent has been discharged a reaction occurs between the prepolymer and the air humidity. This leads to the formation of a durable foam. Depending on the atmospheric humidity content curing takes place within a relatively short period of time. If air humidity is high curing will take just a few minutes. In the event of two-component foams a separate cross-linking component is additionally provided in the pressurized can.

Special valves serve to discharge or expel the foam, with said valves clearing the foam path in that they are tilted or pushed down. During handling and intermediate storage, however, they must reliably seal off the system. Should such sealing action prove to be insufficient, moisture will diffuse into the valve mechanism causing the prepolymers in the valve to harden which impairs the correct functioning of the valve. In the worst case, the valve will be blocked completely as a result of the polymer that has formed inside.

Due to the fact that the internal pressure of the pressurized can is usually not sufficient to cause a complete reset of the valve after triggering, spring elements are used. Disk valves are known that provide for a valve closure element to be joined via a coil spring to a retaining part serving as abutment. The retaining part is allowed to freely project into the inner portion of the pressurized can. The spring is mounted between retaining part and valve closure element securing it firmly on the valve disk. One problem with the use of coil springs is that their function can be impaired or blocked due to the formation of deposits.

Another problem with conventional disk valves is the sealing effect in the stem area. The stem is movably arranged within the valve body, whereby the tightness is mostly achieved with the aid of sealing lips. Here, too, deposits may form which impair the proper sealing function.

It is, therefore, the objective of the present invention to provide a valve that eliminates the above described disadvantages associated with prior-art valves. Said valve shall prevent moisture from entering the valve area within the pressurized can. At the same time, it must also be possible, however, to connect application/discharging aids, for example spray guns. The valve should be of simple construction and provide a high degree of operational safety. In particular, such a valve should also have a less susceptible spring mechanism.

In order to achieve this objective, the invention proposes, based on a valve of the kind first mentioned above, to provide the stem in two parts, with the upper part having the at least one discharge opening and being integrally connected to the valve body via a circumferentially extending elastic diaphragm, and the lower part having the at least one inlet opening, wherein the lower and upper part of the stem being connected to one another in a form-closed and/or force-closed manner.

The terms "can-side" and "valve-side" as used in the description and claims denote, with reference to an extension along the central axis of a pressurized can, the end of a part or portion facing towards or into the pressurized can (can-side) or the end of a part or portion that points out of the can in the direction of the valve (valve-side).

The inventive solid matter valve for pressurized cans is provided with a customary valve disk in which a central circular cutout has been arranged. Between the cutout and the outer edge, the valve disk as a rule has a trough-shaped profile with an upright inner rim to which the valve body is attached.

The valve body itself can be attached to the valve disk by molding in a manner known per se, i.e. the upright/raised inner rim of the valve disk is located inside the valve body. Alternatively and preferred here, is an embodiment in which the valve body is adapted to the shape of the valve disk, has an upright rim provided with an outward projection that extends over the inner rim of the valve disk. Such a valve body is pressed into the valve disk from the bottom side.

Moreover, the valve body has an outwardly extending area that is adapted to the can-side contour of the valve disk and is in close contact with it. The projection pointing outwardly and extending over the inner rim of the valve disk secures the valve body on the valve disk. The internal pressure of the pressurized can ensures a high contact pressure and tightness in this area.

With a view to improving the sealing effect even more, it may be expedient to provide the valve body in the area where it is in contact with the valve disk with concentrically extending circumferential seal lips.

The valve body has a central cutout in which the stem of the valve is arranged so as to be vertically movable. On the can side, the stem has at least one inlet opening for the passage of the can contents, whereas on the valve side there is at least one discharge opening through which the can contents can exit upon valve actuation.

According to the invention the stem is divided into an upper and a lower part, with the two parts being interconnected in a form- and/or force-closed way. The lower, can-side part of the stem features the inlet opening, while the discharge opening is arranged on the upper, valve-side part, with the openings being connected by a duct.

As proposed by the invention, the upper part of the stem is integrally connected to the valve body via a diaphragm. Integrally connected means that valve body, upper part of the stem and a concentric diaphragm arranged so as to provide the connection between the two parts are manufactured to form a single piece or unit. Such a construction can easily be produced by injection molding. This ensures that the narrow gap that exists between the valve body and the stem and makes stem movement possible, is closed on the valve side; accordingly, the contents of the can cannot pass through and exit at this point when the valve is opened or closed.

Preferably, the elastic diaphragm extends along the valve-side edge of the lower part of the stem. A stepped design can be used for the diaphragm, i.e. the diaphragm can have a wave-like shape. In this way, a reserve in surface area is brought about that allows movement of the stem without allowing excessive tension to act on the diaphragm. Between the upper edge of the valve body and the elastic diaphragm there is a concentric recess which contributes to the elasticity and surface area reserve of the diaphragm. Moreover, this prevents the movement of the stem from being transferred directly to the upper edge of the valve body, which is important for the securing and sealing of the valve body. Elasticity in this context is achieved through the geometry and thickness of the diaphragm.

Actuation of the valve causes the stem to be pressed in vertically to dispense the can contents—usually by means of a dispensing aid or a spray gun—with the downward movement of the stem resulting in the diaphragm to be pushed down as well. This leads to a change in the contour, which exerts a certain tension and is absorbed by elasticity. The stepped configuration of the diaphragm causes this movement and the resulting tension to be absorbed in the area of the steps.

The two parts of the stem are connected to each other in a form- and/or force-closing manner. This means that they form a functional unit and are firmly connected to each other. In the center, the two parts form a central duct or channel for dispensing the contents of the can.

In particular, in the duct of the lower part of the stem a central seating arrangement has been provided in the valve-side area accommodating the can-side end of the upper part of the stem. For this purpose, a circumferential enlargement can be arranged in the seating area of the lower stem part, in which an outer circumferential bead of the upper part engages in a form-closed way. Between the valve body and the lower part of the stem a sealing element is arranged. Preferably, this is a circumferential sealing lip arranged on the can side of the valve body, which interacts with a circumferential projection of the lower part of the stem. When the valve is in closed position, this sealing lip provides a reliable seal at said projection, but enables a passage for the contents of the can to be cleared as soon as the stem is moved in downward direction.

As already mentioned hereinbefore, the solid matter valve proposed by the invention needs a spring element for a perfect closing function. For this purpose, the valve body is preferably provided with a can-side extension, which surrounds the lower part of the stem and serves as a retaining element for the spring element.

This extension, which concentrically surrounds the lower part of the stem, also increases the stability and rigidity of the valve body.

Said spring element may consist of a conventional coil spring mounted in a cage, which in turn is located on the extension of the valve body. Preferably, however, the spring element is a spring clip, which is secured to the valve body by means of retaining arms. For this purpose, these retaining arms engage in recesses existing in the extension of the valve body, either through ends of the arms bent towards the valve body or through notched out retaining tongues which engage in the recesses and which, in addition to locking, also exert a spring action.

The spring clip itself preferably has a convex shape towards the direction of the valve and shows a dent or depression centrally in the area of the convexity, into which a projection of the lower part of the stem reaches. This arrangement serves to center the stem, which is thus held in the center of the interior of the valve body.

Preferably, the upper part of the stem is provided with a sealing sleeve made of an elastic material, for example a thermoplastic elastomer, which is suitable for producing the tightly sealing seat for a foaming gun. On the valve side, this sealing sleeve terminates in a fixing ring, which in contrast is made of a hard material, such as polyoxymethylene, and serves as an abutment for the triggering element of the sealing gun. It is recommendable for the fixing ring and sealing sleeve to be connected to each other in a form-closing manner, for example in such a way that the fixing ring is provided with a can-side circumferential groove in which a circumferential projection of the sealing sleeve engages. At the same time, the fixing ring and/or sealing sleeve are fitted into a receding portion in the upper part of the stem so that a firm connection is achieved. Moreover, the fixing ring may then also be securely mounted via a press fit at the valve side end of the upper part of the stem.

The valve body is manufactured in a customary manner from a thermoplastic material, for example a polyalkylene, especially polyethylene or polypropylene.

The invention is explained in more detail by way of the enclosed figures, where

Figure 4:
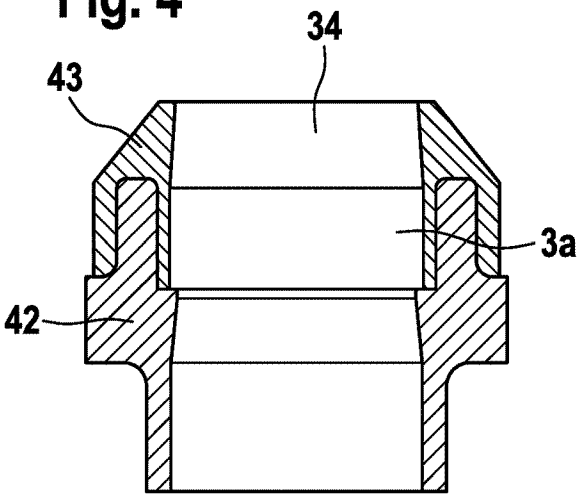
Figure 3:
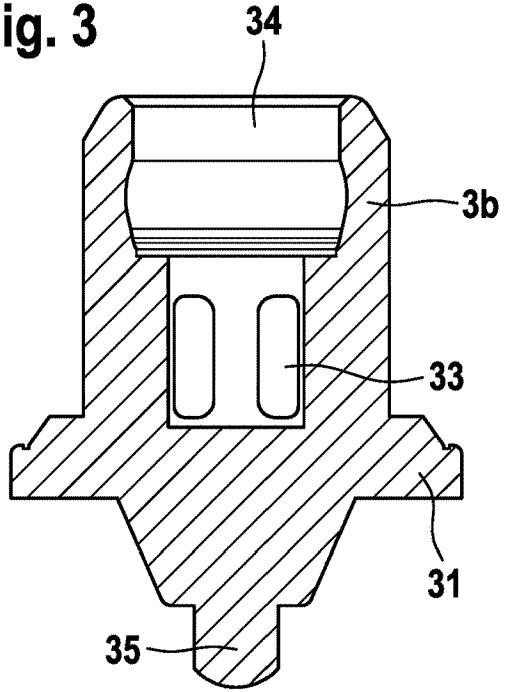
Figure 2:
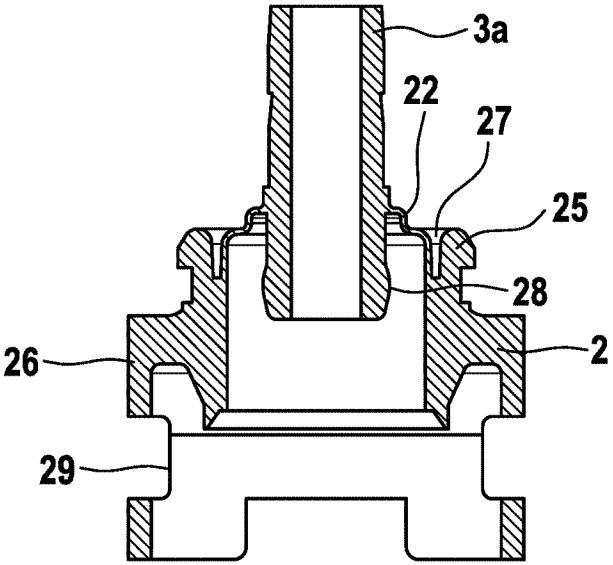
Figure 5:
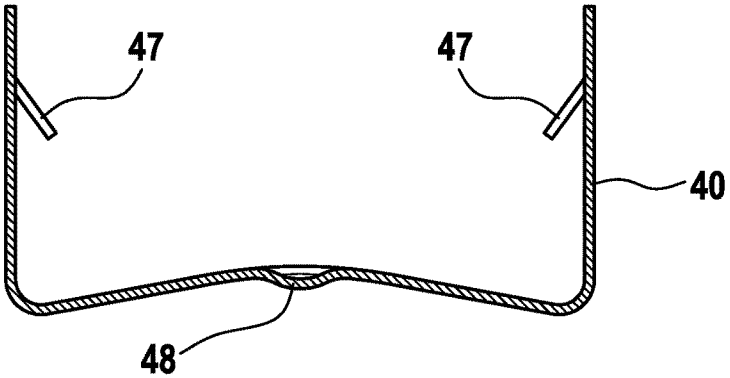

FIG. 1: shows a sectional drawing of the inventive valve arranged in a valve disk;

FIG. 2: is a sectional drawing of the combination of upper part of the stem and the valve body;

FIG. 3: shows a sectional view of the lower part of the stem;

FIG. 4: illustrates the upper part of the stem with sealing sleeve and fixing ring; and FIG. 5: depicts the spring element.

FIG. 1 is a sectional view of an embodiment of the solid matter valve proposed by the invention, with the valve arranged in a valve disk 1. Via valve disk 1 the solid matter valve is clamped to the dome of the can, with the valve disk via its crimping rim 15 extending over and wrapping around the upper rim of the can dome. Valve disk 1 itself has a central cutout around which a channel- or trough-shaped central portion 11 extends. On the inside, the valve disk 1 terminates in the upright rim 12 while on the outside the trough rises towards crimping rim 15.

The valve body 2 has been arranged in valve disk 1, with valve stem 3 being guided within the central circular cutout of the valve body. Via an upright rim 24 with outwardly extending projection 25 the valve body 2 is secured to the upright inner rim 12 of valve disk 1; an outwardly extending round face 26 adapts closely to the underside of trough 11 of the valve disk 1. The shape of the valve body 2 is stabilized by the can-side circumferential outer rim 26.

The valve body 2 has been provided with the required sealing elements to make sure the valve seals off safely at valve disk 1 around stem 3. If appropriate, these elements may comprise of sealing lips arranged to act on the rounded area of valve disk 1 in the transition zone between trough 11 and upright rim 12. On the can side, i.e. the side of valve body 2 facing the can interior, at least one circumferential sealing lip 23 is arranged that for the main part extends parallelly to the configuration of the central cutout 21 thus acting on the base 31 of the stem. Base 31 serves as sealing face or seat and is a concentric enlargement of the stem 3 having a slightly arched shape. In the rest or closure position of the stem 3, sealing lip 23 acts against the base 31 and thus prevents the contents of the can from entering the inlet openings 33 provided in the stem.

The stem is guided within the central cutout 21 of the valve body 2, said stem having a central duct 34 that serves as discharge channel for the can contents. On the can side, the stem is provided with at least one lateral penetration 33 that serves as inlet opening for the can contents. In the closure position as shown in the figure, this inlet opening 33 is closed off through the sealing effect of lip 23 of valve body 2 acting against the sealing face or seat 31 of the stem. When the stem is pressed down, the lip loses its sealing effect and via the inlet opening 33 can contents enters and is discharged through duct 34.

In the embodiment illustrated, the stem has in its lower part 3*b* inlet openings 33, which are evenly distributed over the circumference.

According to the invention, stem 3 of the solids valve is divided into two parts, an upper part 3*a* and a lower part 3*b*. The upper part 3*a* embraces the larger part of duct 34 and is connected to valve body 2 via a diaphragm 22. Valve body 2 and upper part 3*a* of stem 3 are manufactured by injection molding so as to form a single piece or unit and preferably consist of the same material.

The lower part 3*b* of the stem interacts with the sealing lip 23, which acts against the base 31 of the lower part 3*b*. Several sealing lips may be provided.

The upper part 3*a* comprises the discharge opening of the valve proposed by the invention, and the inlet openings 33 for the can contents are located in the lower part 3*b*.

Diaphragm 22 connecting the upper part 3*a* of the stem to the valve body 2 is concentrically arranged around the stem and has an essentially stepped configuration along the outside of the lower part 3*b* of the stem. The diaphragm 22 is sufficiently elastic to absorb the movement of stem 3 when the pressurized can is actuated. The stepped configuration yields a reserve in surface area that compensates for the elongation of the diaphragm when the valve is actuated causing a displacement of stem 3. A circumferential recess 27 in the valve body 2, which leaves a gap between the upper end 24 of the valve body 2 and the diaphragm 22, also serves this purpose. Diaphragm 22 starts at the inside of the valve body 2, follows the configuration of its inner wall in the can-side area and then continues in steps to the outer wall of the upper part 3*a* of the stem.

The lower part 3*b* of the stem has a can-side extension 35 next to its base, which serves as an abutment for the spring element 40. Only the central area of spring element 40 has been illustrated in the figure. When the stem is actuated, the spring element 40 is moved down into the can and thus causes the passage between the sealing lip 23 and the base 31 at the lower part 3*b* of the stem to be cleared.

The valve body is provided with two recesses 29 in the part 26 projecting into the can, said recesses engaging with the retaining arms of the spring element.

The upper part 3*a* and the lower part 3*b* of the stem are connected to each other in a form-closed manner. For this purpose, the upper part 3*a* of the stem has a circumferential bead 28 at its can-side end, which projects precisely into a corresponding enlargement of duct 34 in the area of the lower part 3*b* of the stem.

The upper part 3*a* of the stem has been provided with a sleeve which is used as a seal for a connected discharging aid, which may be a foaming gun, for example. Preferably, such a sealing sleeve is made of a thermoplastic elastomer material which has the required sealing properties. The upper part 3*a* of the stem terminates in a fixing ring 43 made of a relatively hard material, said ring projecting into the receptacle of a foaming gun and transmitting the exerted actuation pressure on to the stem. Sealing sleeve 42 and fixing ring 43 are firmly connected to each other. For this purpose, the fixing ring has an annular incision 44 into which a projection 45 of the sealing sleeve protrudes. The sealing sleeve 42 is additionally secured via a receding portion 46 located in the upper part 3*a* of the stem.

In FIG. 2, the combination of upper part 3*a* of the stem and valve body 2 can be seen. The upper part of the stem 3*a* is connected to the valve body 2 via the diaphragm 22, with said diaphragm 22 having a step-shaped configuration. This stepped configuration makes sure there is a reserve in surface area and at the same time guarantees the elasticity of the diaphragm and thus the flexible integration of the upper part 3*a* of the stem into the valve body.

The outwardly protruding projection 25 of the valve body serves to secure the body at the inner edge of the valve disk, with the circumferential groove 27 providing the elasticity that is required for the integration of the valve body 2 with the valve disk 1.

The can-side extension 26 of the valve body 2 ensures on the one hand that the body is firmly seated on the underside of the trough 11 of the valve disk 1 and on the other hand provides the recesses 29 for securing spring element 40.

The can-side portion of the stem part 3*a* has a circumferential bead 28 that fits precisely into a corresponding extension of channel 34 in the area of the lower part 3*b* of the stem, see FIG. 3. The figure shows the inlet openings 33 for passage of the contents of the can when the valve is actuated and the base 31, which provides a seat sealing the stem against the valve body 2. A can-side extension 35 of the lower part 3*b* of the stem 3 interacts with the spring element 40 and at the same time serves to guide and support the stem 3.

In FIG. 4, channel 34 of the stem is shown with mounted sealing sleeve 42 for the connection of an application aid, such as a discharging gun. At the upper edge of the upper stem part the fixing ring 43 is arranged, which is made of a hard material and absorbs the pressure exerted by the application aid upon valve actuation.

In FIG. 4 the sealing sleeve 42 and the fixing ring 43 are shown as sectional view, the upper part 3*a* of the stem, however, in top view. It can be seen that the sealing sleeve 42 and the fixing ring 43 are connected to each other by a kind of dovetail joint, with the sealing sleeve 42 being secured via a receding portion of the stem part 3*a*. Sleeve and fixing ring are interconnected in a kind of press fit.

FIG. 5 illustrates the spring clip 40, which is fitted with two inwardly projecting teeth 47, via which the spring clip 40 is secured in the recesses 29 of valve body 2. Teeth 47 enable a very elastic fit to be obtained and snap into the recesses 29; they serve as retaining arms of the spring clip.

In its central lower portion, the spring clip 40 is provided with a dent 48, which protrudes into the can. The dent 48 is located close to the extension 35 of the lower part 3*b* of the stem and absorbs the pressure exerted on the stem by the discharging aid. Under pressure, the spring clip 40 is caused to bend inwards into the can and after completion of a discharging operation ensures that the stem is returned to its closed position.

The invention claimed is:

1. An apparatus for the dispensing of assembly foams, the apparatus comprises a solid matter valve and a pressurized can and a valve disk (1), wherein the solid matter valve comprises: a valve body (2) having an upper edge and a lower edge and arranged in the valve disk (1), a stem (3)

mounted in a central cutout (21) of the valve body (2) and having at least one inlet opening (33) for the contents of the pressurized can, said opening being cleared by actuation of the stem (3), with a duct (34) connecting with the inlet opening (33) serving as a discharge opening, the valve body having at least one sealing element acting between the valve body (2) and the stem (3), as well as a spring element (40), characterized in that the stem comprises an upper part (3*a*) and a lower part (3*b*) wherein the upper part is connected to the lower part as form-closed or force-closed, a circumferential elastic diaphragm (22) integrally connecting the valve body (2) to the upper part (3*a*) of the stem (3), and the two parts (3*a*, 3*b*) of the stem (3) forming a functional unit which accommodates the duct (34), the spring element having a central dent into which an extension (35) of the lower part (3*b*) of the stem (3) protrudes.

2. Apparatus according to claim 1, characterized in that the elastic diaphragm (22) has a stepped configuration and extends around the upper edge of the lower part (3*b*) of the stem (3).

3. Apparatus according to claim 1, characterized in that a circumferential groove (27) is arranged between the upper edge of the valve body (2) and the elastic diaphragm (22).

4. Apparatus according to claim 1, characterized in that the circumferential elastic diaphragm (22) has a reserve in surface area to compensate for elongation of the diaphragm when the stem (3) is actuated.

5. Apparatus according to claim 1, characterized in that a central seating area of the lower part (3*b*) has been provided with an inner circumferential enlargement engaging an outer circumferential bead (28) of the upper part (3*a*) of the stem (3) to accommodate the outer circumferential bead (28) in form-closing.

6. Apparatus according to claim 1, characterized in that the sealing element of the valve body (2) comprises a circumferential sealing lip (23) on the lower side of the valve body which interacts with a circumferential projection (31) of the lower part (3*b*) of the stem.

7. Apparatus according to claim 1, characterized in that the valve body has an extension (26) on its lower side which surrounds the lower part of the stem (3) and serves as a retaining element for the spring element (40).

8. Apparatus according to claim 7, characterized in that the spring element (40) of the valve body is a spring clip having two arms, wherein the arms are secured in recesses (29) on the valve body (2).

9. Apparatus according to claim 8, characterized in that the arms of the spring clip are bent toward each other.

10. Apparatus according to claim 8, characterized in that recesses (29) engage the arms of the spring element (40).

11. Apparatus according to claim 1, characterized by a sealing sleeve surrounding the upper part (3*a*) of the stem (3).

12. Apparatus according to claim 11, characterized in that the upper part (3*a*) of the stem (3) terminates in a fixing ring (43), wherein the fixing ring (43) having a circumferential groove (44) on its lower side, into which a circumferential projection (45) of the sealing sleeve is form-closed.

* * * * *